US005470093A

United States Patent [19]

Kiser

[11] Patent Number: 5,470,093

[45] Date of Patent: Nov. 28, 1995

[54] AUXILIARY WHEELCHAIR ATTACHMENT FOR PULLING A WHEELCHAIR

[75] Inventor: Charles M. Kiser, Marysville, Wash.

[73] Assignee: Lovella V. Torp, Missoula, Mont.

[21] Appl. No.: 320,648

[22] Filed: Oct. 11, 1994

[51] Int. Cl.[6] ..... A61G 5/10

[52] U.S. Cl. ..... 280/304.1; 5/81.1; 280/47.2; 280/47.25; 280/47.31

[58] Field of Search ..... 280/1.5, 47.25, 280/63, 64, 65, 304.1, 250.1

[56] References Cited

U.S. PATENT DOCUMENTS

| | | | |
|---|---|---|---|
| 1,327,864 | 1/1920 | Everingham | 280/47.25 |
| 1,356,034 | 10/1920 | Black | 280/47.25 |
| 4,470,610 | 9/1984 | Wilson | 280/47.25 |
| 4,671,522 | 6/1987 | Fragione, Jr. | 280/47.25 |
| 5,020,560 | 6/1991 | Turbeville | 280/304.1 |
| 5,074,574 | 12/1991 | Carwin | 280/304.1 |

*Primary Examiner*—Mitchell J. Hill
*Attorney, Agent, or Firm*—Harry M. Cross, Jr.

[57] ABSTRACT

A wheelchair attachment for enabling an occupied wheelchair to be pulled or pushed by an attendant which comprises an enclosed frame having a closed end and two sides extendable from the forward end toward a wheelchair, frame mounting connectors for detachably mounting the frame to a wheelchair with said frame projecting outwardly of the wheelchair whereby an attendant facing forward may grip the frame and pull or push the wheelchair, and frame stabilizers connected to the frame and detachably mountable to the wheelchair for positioning the frame in a desired plane projecting outwardly of the wheelchair. The frame and stabilizers are stiff enough that the attendant can lift up on the closed end to elevate the small front wheels of the wheelchair so that the wheelchair can be pulled along with its front wheels elevated.

22 Claims, 4 Drawing Sheets

FIG. 1
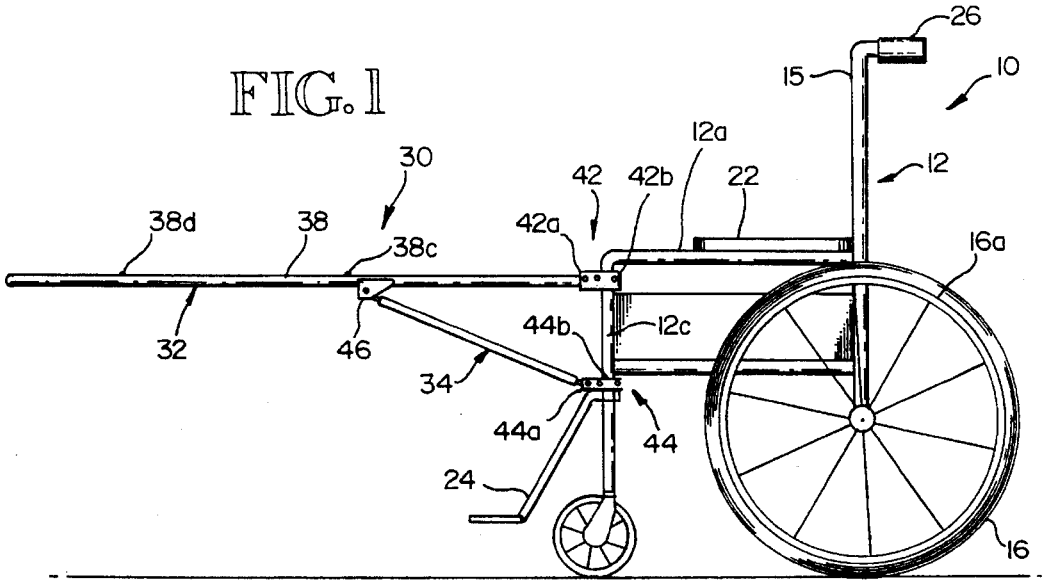
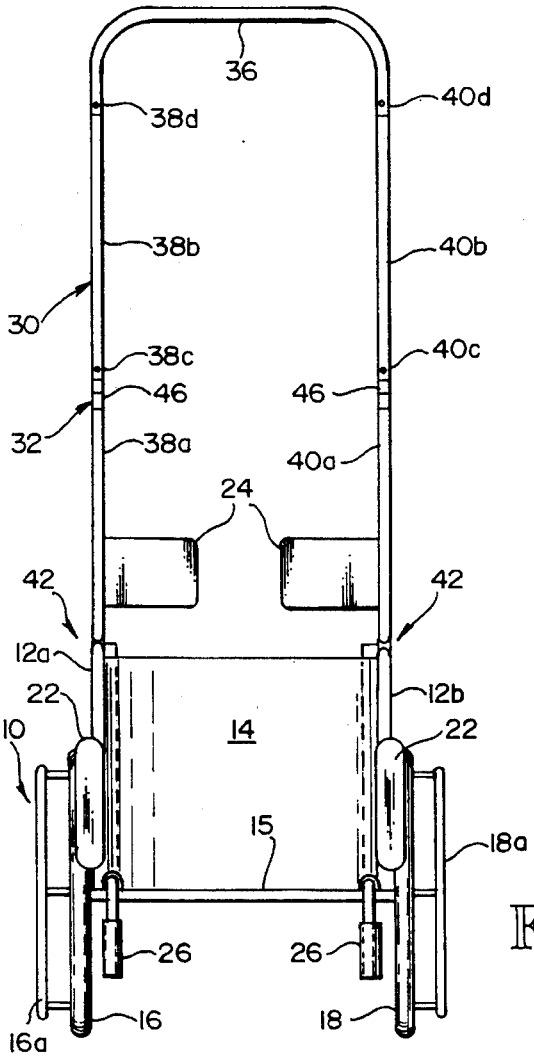
FIG. 2
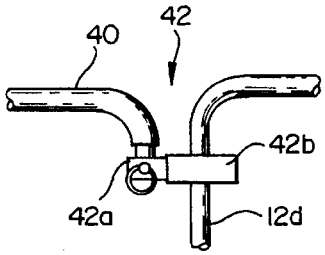
FIG. 3

AUXILIARY WHEELCHAIR ATTACHMENT FOR PULLING A WHEELCHAIR

BACKGROUND OF THE INVENTION

1. Field of the Invention

This invention relates to wheelchairs for use by disabled persons. More particularly this invention relates to auxiliary attachments for wheel chairs that enable one to pull an occupied wheelchair along a path or a trail.

2. Brief Description of the Prior Art

Although a variety of attachments for wheelchairs have been proposed, none would enable an occupied wheelchair to be pulled along a path or a trail such as would be required to take a disabled person hiking or camping. The conventional rearwardly-oriented handles designed to enable one to push or guide a wheelchair in front of him do not provide the kind of leverage or orientation to necessary for propelling an occupied wheelchair along a path or a trail. Moreover, none are adaptable to attachment to the front of a wheelchair so that the occupant could be pulled along rough terrain or to the rear of a wheelchair so that the occupant could be pushed along rough terrain.

In situations where the wheelchair occupant needs or desires an unobstructed front, such as when fishing, shooting, bird watching, viewing sports events, and so forth, where it would be awkward or very difficult to position the wheelchair by the convention rear handles, it would be desirable to have a system that could be adaptable to attachment to the rear of the wheelchair so that the occupant could be pushed into an appropriate location. Such a system should also be adaptable to attachment to the front of the wheelchair so that the occupant could be pulled over rough terrain to the vicinity where the wheelchair could be located and maneuvered from behind as needed. As an example, for skeet or trap shooting or for bank-fishing, the wheelchair would have to be positioned and relocated over the field depending and then maneuvered for just the right position on uneven terrain. The conventional wheelchair's rear handles would not provide adequate means for maneuvering the wheelchair due to inadequate leverage.

SUMMARY OF THE INVENTION

A primary object of this invention is to provide a wheelchair attachment that would enable one to pull or push an occupied wheelchair on rough or uneven terrain such as would be encountered on a hiking path or path. Another object is to provide such an attachment that is itself portable and detachable from the wheelchair. A further object is to provide such an attachment that can be mounted forwardly of the wheelchair for pulling the wheelchair and, alternately, that can be mounted rearwardly of the wheelchair for pushing the wheelchair without obstructing the front view of the occupant.

In accordance with these objects a wheelchair attachment for enabling an occupied wheelchair to be pulled by an attendant which comprises frame means providing an enclosed frame having an end and two sides extendable from the end toward a wheelchair, frame mounting means for detachably mounting the frame means to a wheelchair with the frame means projecting outwardly of the wheelchair whereby an attendant may grip the frame and pull or push the wheelchair, and frame stabilizing means connected to the frame and detachably mountable to the wheelchair for positioning the frame in a desired plane projecting outwardly of the wheelchair. The frame mounting means comprises a pair of frame connectors, each frame connector having a first part attachable to the wheelchair and a second part attached to an innermost end of one of the elongated frame segments. The frame stabilizing means comprises a pair of elongated stabilizing segments, a pair of first stabilizing connectors each pivotally mounting an outwardmost end of one of the stabilizing segments to one of the elongated frame segments, and a pair of second stabilizing connectors each having a first part attachable to the wheelchair and a second part attached to an innermost end of one of the stabilizing segments. The first stabilizing connectors are constructed and arranged to mount the elongated stabilizing segments to the elongated frame segments in a manner whereby the stabilizing segments may be angled downward from their respective first stabilizing connectors so that their respective second stabilizing connectors may be attached to the wheelchair at an elevation lower than the attachment of the frame connectors to the wheelchair.

The wheelchair attachment frame connectors and second stabilizing connectors are so constructed and arranged for attachment to a wheelchair side frame whereby the frame segments and the stabilizing segments, when attached to the wheelchair, will extend outward from the wheelchair without obstructing a wheelchair occupant's legroom. The wheelchair attachment frame segments and the stabilizing segments are fabricated in a form and from a material to render the frame forward end and sides stiff enough that an attendant, when the attachment is attached to the wheelchair and projecting forwardly thereof, may conveniently lift up on the frame forward end to raise a wheelchair's small front wheels clear of the ground whereby the attendant may pull the wheelchair with its front wheels elevated. Also, The wheelchair attachment frame segments and the stabilizing segments are fabricated in a form and from a material to render the frame forward end and sides stiff enough that an attendant, when the attachment is attached to the wheelchair and projecting forwardly thereof, may conveniently push down on the frame forward end to raise a wheelchair's rear large wheels clear of the ground whereby the attendant may pull the wheelchair with its rear wheels elevated.

BRIEF DESCRIPTION OF THE DRAWINGS

FIG. 1 is a side elevation view of a wheelchair with the attachment of this invention mounted to the wheelchair frame and projecting forwardly of the wheelchair;

FIG. 2 is a top plan view of the FIG. 2 wheelchair and attachment;

FIG. 3 is a detail view illustrating a simplified connector for detachably connecting the FIGS. 1–2 attachment and the wheelchair frame that would permit quick and easy attachment mounting to, and unmounting from, the wheelchair;

DESCRIPTION OF THE PREFERRED EMBODIMENT

Figure 10:
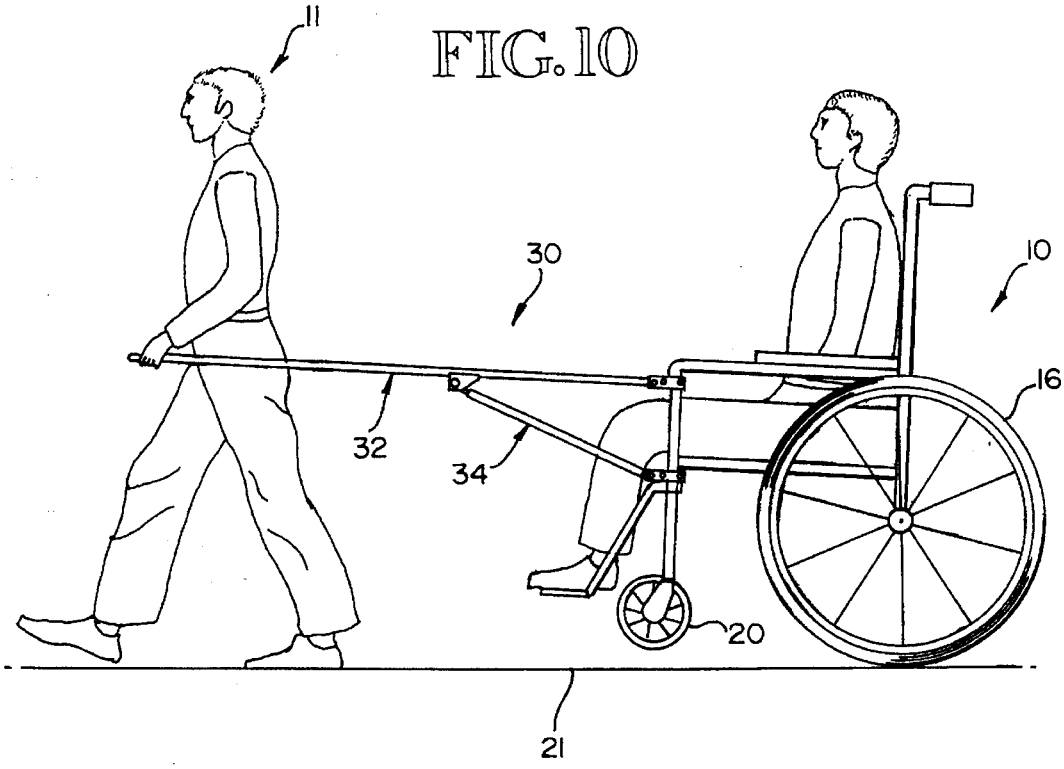
FIG. 10 is a side elevation view of the FIG. 1 assembly with the wheelchair occupied and a person positioned within the attachment's main frame for pulling the occupied wheelchair.

Referring to FIGS. 1, 2 and 10, a typical wheelchair 10 for conveying disabled persons comprises a frame 12, a seat 14 connected to the frame 12, two large rear wheels 16, 18 connected to the frame 12 for directly supporting the weight of the disabled person, each wheel having associated therewith an outer ring 16*a*, 18*a* which may be grasped and rotated by the disabled person to propel himself/herself, a pair of small front wheels 20 swivelably mounted to the frame 12, support structures 22, 24 for supporting the arms and legs of the disabled person, and a pair of spaced apart handgrips 26 connected to the frame 12 at the upper rear thereof for being grasped by an attendant to thereby enable the attendant to push and guide the wheelchair from the rear.

Because of the location of the rearward-oriented handgrips 26, an attendant will have difficulty in pushing and maneuvering an occupied wheelchair over rough terrain. Even a gravel pathway would present difficulties. If the attendant were to attempt to push an occupied wheelchair up a slope, or along a hiking path or trail, he/she would have much difficulty in doing so, and may well find the task impossible. The location of these handgrips, being behind and at the top of the frame 12, would cause the attendant to press forward and downward as he or she propelled the wheelchair forward, thereby forcing the small front wheels 20 firmly against the ground. The result would be a very rough ride for the wheelchair occupant over even a gravel pathway as the small front wheels would jar and shake the wheelchair frame.

The frame 12 can take various forms, but typically provides a pair of tubular side frames 12*a*, 12*b* that are cross-connected in some manner. In portable wheelchairs, wherein the seat 14 and backrest 15 are provided of a foldable material such as canvas fabric, the cross-connection between the side frames 12*a*, 12*b* is some form of scissors mechanism that can be closed and opened to collapse and extend the wheelchair. In one form or another, the wheelchair side frames 12*a*, 12*b* will incorporate some structure that defines the forward, generally vertical corners of the wheelchair, such as vertical tubular members 12*c*, 12*d* (see FIGS. 1 and 3). Between these forward corners, the wheelchair's leg support structure 24 will be located and extended forwardly of these corners, such as shown in FIG. 1. The structure that defines the forward corners, such as members 12*c*, 12*d*, will usually mount the wheelchair's small front, caster-type, wheels 20. The attachment 30 of the present invention is designed, in its preferred embodiment, to detachably mount to the wheelchair structure that defines the wheelchair's forward corners, such as members 12*c*, 12*d*.

The attachment 30 of the present invention comprises a main frame 32 that is connected to the wheelchair 10 and extends forwardly of the wheelchair in a generally horizontal plane as shown in FIG. 1. The main frame 32 is reinforced and supported by a pair of support members or struts 34 that connect to the wheelchair and to the main frame, one such support member being shown in FIG. 1. The main frame 32 is generally U-shaped and has a closed forward end section 36 and left and right side sections 38, 40 as shown in FIG. 2. The side sections 38, 40 may be comprised of two or more segments 38*a*, 38*b* and 40*a*, 40*b* joined together by interlocking joints 38*c*, 40*c*, with the forward-most segment joined to the closed forward end section 36 by interlocking joints 38*d*, 40*d* as shown in FIG. 2. The interlocking joints 38*c*, 40*c*, 38*d*, 40*d* may incorporate spring-loaded snap couplers which will releaseably secure the adjacent segments together against whatever pulling force the attachment reasonably can be expected to undergo.

The innermost ends of the side segments 38*a*, 40*a* are connected to the wheelchair by connectors 42 that enable the main frame to be easily and quickly mounted to and unmounted from the wheelchair. The innermost ends of the support members 34 would likewise be mounted to the wheelchair by connectors 44 for easy and quick mounting to and unmounting from the wheelchair. The main frame connectors 42 and the support member connectors 44 would be provided in two sections; a first section 42*a*, 44*a* being attached to the wheelchair, and a second section 42*b*, 44*b* being attached to the main frame or to the support member. As shown in detail view FIG. 3, an appropriate coupler would be employed to detachably secure the main frame or the support member to its connector; FIG. 3 showing coupler 42*c* simply as a pin securing the main frame connector section 42*b* to the embodiment shown in FIG. 3, the connector first section 42*a* comprises a clam shell clamp that is fastened to the wheelchair frame 12 and that provides a vertically-oriented aperture through which the connector second section 42*b* extends to be fastened therein by coupler pin 42*c*. Similarly, the connector 44 for the support members 34 would provide a first section 44*a* attached to the wheelchair frame 12 and having a clam shell clamp and a vertically-oriented aperture for receiving the connector second section 44*b*.

The outermost ends of the support members 34 are each attached to the innermost segments 38*a*, 40*a* of main frame 32 by a connector 46 as shown in FIG. 2. Each connector 46 may be permanently affixed to its respective segment 38*a*, 40*a* and pivotally affixed to its respective support member 34. Each connector 46 makes a support members 34 an integral part of an innermost frame side subassembly so that each subassembly may be mounted to or unmounted from the wheel chair as a unit. Consequently, in mounting the attachment 30 to the wheelchair, it is a simple procedure to mount each innermost side assembly to the wheelchair, then add the additional side segments 38*a*, 38*b* and 40*a*, 40*b* to make up the complete side sections 38, 40, and finally add the closed forward end section 36 to complete the assembled configuration of the attachment 30.

The configuration of the innermost frame side subassembly, composed of an innermost side segment 38*a*, 40*a*, connector 46 and support member 34 determines the attitude of the plane of the main frame 32 when connected to the wheelchair. Preferably this plane is generally horizontal, as shown in FIG. 1. This horizontal plane will position the closed forward end section 36 at an elevation that is slightly lower than waist-height for an average person's height. Consequently, an attendant who will be pulling the wheelchair, may lift the forward end section 36 up to his or her waist-height, thereby lifting the small front wheels 20 of the wheelchair up off the ground, as shown in FIG. 10. With the wheelchair in this attitude, the attendant will find it easy and convenient to pull the occupied wheelchair over rough or uneven terrain without unduly jarring the wheelchair's occupant.

In some configurations of the innermost frame side subassembly, it may be desirable to enable adjustment so that the plane of the main frame 32 can be slightly adjusted so as to be tilted upward or downward. This feature would be desirable if the attendant were taller or shorter than an average height, so that the elevation of the forward end section 36 could be adjusted accordingly. This adjustability could be provided by permitting the first section 44*a* of connectors 44 to be located upward or downward on the wheelchair frame 12. Alternately, the effective length of the support members 34 could be alterable. Either mode of adjustment, when effected, would alter the plane of the main frame 32. For example, if the first section 44*a* of the connectors 44 were lowered on the wheelchair frame from the elevation shown in FIG. 1, the main frame 32 would tilt downward. Likewise, if the support members 34 were effectively shortened from the length shown in FIG. 1, the main frame 32 would tilt downward. Raising the elevation of the first section 44*a* of the connectors 44, or increasing the effective length of support members 34, would effect an upward tilt of the main frame 32 from the plane shown in FIG. 1.

When the attachment 30 is disassembled and removed from the wheelchair, its various segments may be gathered together and aligned, and then stored in some convenient place for later use. The linear segments 38*a*, 40*a*, 34 may be oriented parallel to and overlaying one another and the planer forward end section 36 and intermediate segments 38*b*, 40*b* may be laid in with them to provide a compact assembly that may easily fit within an elongated bag or compartment.

The various segments 38*a*, 38*b* 40*a*, 40*b*, 36, 34 may be provided as tubular elements fabricated from various metals, such as titanium, steel, aluminum, and various kinds of composite materials such as reinforced graphite. Although some longitudinal flexibility in the side segments 38*a*, 40*a* and support members 34 is acceptable, they must be longitudinally stiff enough that the front end of the wheelchair may be lifted off the ground without having to raise the forward end section 36 excessively. It is preferable that these segments and support members be unbending so that the assembly attachment 30 can cantilever forward without any appreciable droop at the forward end section 36. It is also preferable that these segments and support members be relatively stiff enough so that an attendant could press down on the forward end section 36 to cause the wheelchair's large wheels 16 to lift clear of the ground, with the small front wheels 20 serving as fulcrum points, when such a maneuver is necessary to clear an obstacle on the path or trail. Preferably each segment 38*a*, 40*a* is about 20–24 inches long and the forward end section 36 is about 10–14 inches long (in the longitudinal direction). The joint sections 38*c*, 40*c*, 38*d*, 40*d* must be stiff enough that no flexibility occurs through the joints.

The preferred embodiment of the wheelchair attachment 130 shown in FIGS. 4–7 comprises a main frame 132, main frame support members 144 (one being shown in FIG. 4), wheelchair connectors 142 and 144, and support member-to-main frame connectors 146. The main frame comprises a closed forward end section 136, side sections 138, 140 composed of two segments each 138*a*, 138*b* and 140*a*, 140*b* with the side segments joined together by interlocking joints 138*c*, 140*c* and with the forward-most side segments joined to the closed forward end section 136 by interlocking joints 138*d*, 140*d*. The main frame sections and the support members are metal tubes.

Figure 4:
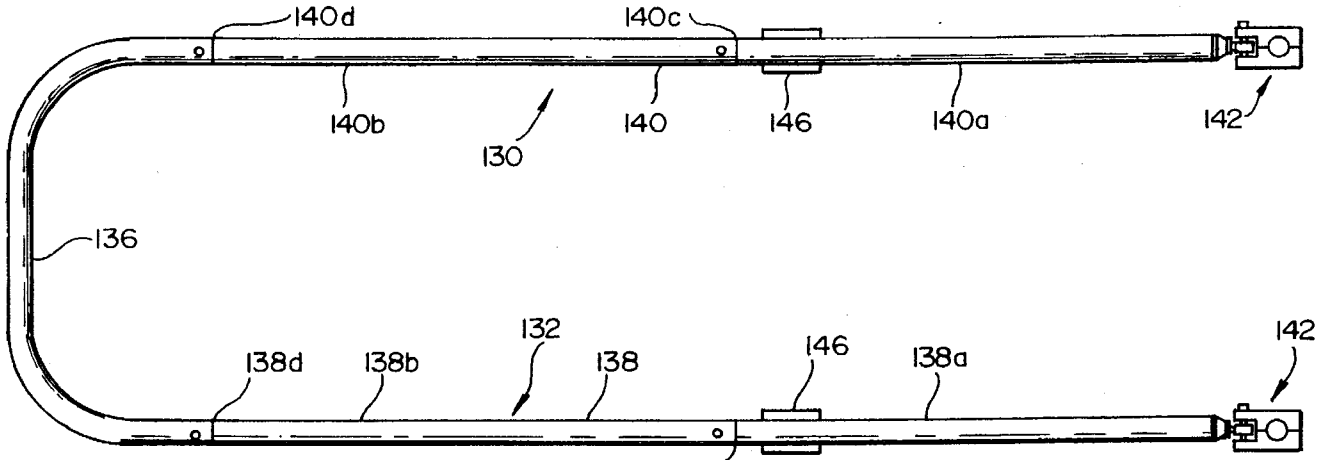
FIG. 4 is a top plan view of the main frame of a preferred, sectionalized wheelchair attachment.
Figure 5:
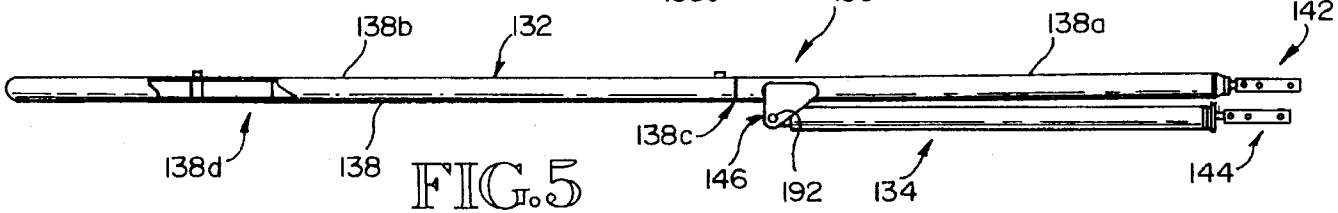
FIG. 5 is a side elevation view of a preferred wheelchair attachment showing the FIG. 4 main frame in side elevation, and also showing an adjustable support member for stabilizing the main frame and for adjusting the attitude of the plane of the main frame.
Figure 6:
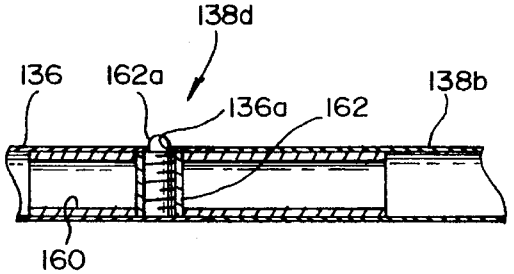
FIG. 6 is a detail view of a section of FIG. 5 illustrating a preferred joint structure between two main frame sections.

The interlocking joints are shown in detail view FIG. 6 as comprising a reinforcing sleeve 160 and a spring-loaded plunger catch assembly 162. The sleeves 160 are fastened within one of the adjacent tubular sections and protrude therefrom for insertion into the adjacent end the mating portion of the interlocking joint. FIG. 6 illustrates joint 138*d* wherein one end of the main frame forward end section 136 is joined to the outermost end of a main frame intermediate side section segment 138*b*. In this view, the sleeve 160 is fastened within segment 138*b*, and is telescopically fitted within the end of forward end section 136. The plunger catch assembly 162 is mounted within the protruding portion of the sleeve 160 with its plunger extending radially outward beyond the outer diameter of the tubular sections. The plunger 162*a* of the plunger catch assembly 162 will be depressed as the forward end section 136 is slipped over sleeve 160 until a radial aperture 136*a* through the wall of tubular section 136 is aligned with the plunger as the tubular sections are mated, at which point the plunger will be extended by its internal spring through the aperture thereby locking the adjacent tubular sections together. The reinforcing sleeve 160 both reinforces the interlocking joint, thereby stiffening the joint, and provides a mounting for the plunger catch assembly 162.

Figure 7:
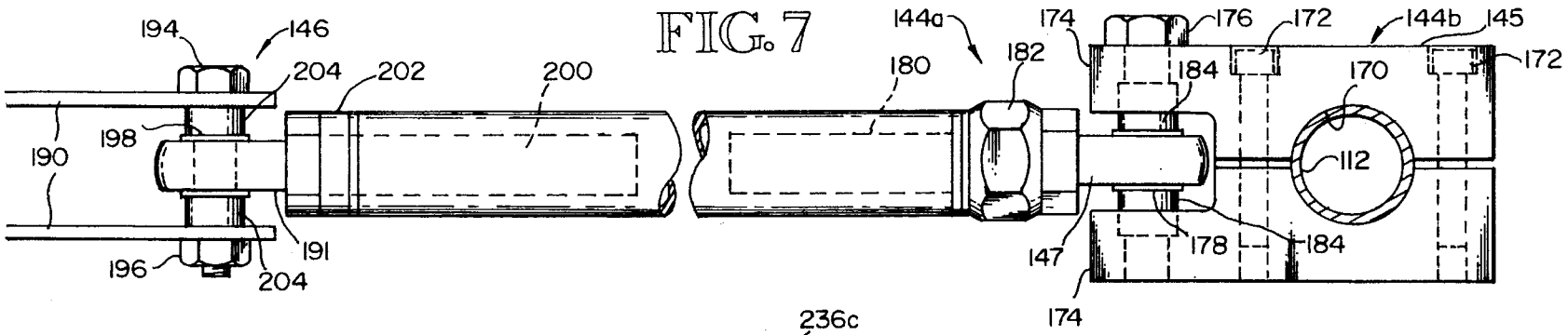
FIG. 7 is an enlarged detail view of a main frame support member illustrating preferred details of construction, and illustrating details of a preferred connector for detachably connecting the support member to a wheelchair frame.

The support member 134 and its connectors 144, 146 are shown in detail in FIG. 7. The configuration of the wheelchair connector 144 composed of sections 144*a*, 144*b* shown in FIG. 7, is also the configuration of the wheelchair connectors 142. This configuration comprises a clamp member 145 and a tie rod 147.

Clamp member 145 is provided in two halves, each of which is configured with one half of a recess, or cavity, 170 for fitting around the wheelchair frame 112. The disassembled halves would be fitted around the wheelchair frame so that the frame 112 extended through the cavity 170, and the two halves would be bolted together by a pair of bolts 172. To accommodate the bolts 172, one half would be bored to receive the bolt shanks and bolt heads and the other half would be threaded to receive the bolt threads. The bolts would be tightened to draw the two halves together around the wheelchair frame 112 and securely fix the clamp member 145 at the desired elevation on the frame 112. The clamp member 145 is configured as a clevis with forwardly-projecting clevis arms 174. A clevis bolt 176 is inserted in the clevis arms 174, extending through a bore in one arm and threaded into a threaded bore in the other arm to provide a clevis pin for securing the tie rod 147.

Tie rod 147 comprises a ball joint end 178, through which the clevis bolt 176 extends, and a threaded shaft 180. The inner end of the support member 134 is provided with an internally-threaded tie rod bearing 182 and tie rod shaft 180 is threaded thereinto. Short cylindrical spacers 184 on either side of the ball joint end 178 serve to center the ball joint end between the clevis arms 174, 176.

Support member connectors 146 join the outermost ends of the support members 134 to the undersides of the adjacent main frame side segments 138*a*. This configuration comprises a pair of angle bracket members 190 fixed to the sides of the tubular side segments 138*a* so as to provide a locus 192 of support member connection (see FIG. 5) underneath the segment 138*a*, and a tie rod 191. A connecting bolt 194 extends through the bracket members 190 with its longitudinal axis defining the connecting locus 192, and is fastened to the bracket members 190 with a nut 196. Bolt 194 provides a pin for securing the tie rod 191.

Tie rod 191 comprises a ball joint end 198, through which the bolt 194 extends, and a threaded shaft 200. The outer end of the support member 134 is provided with an internally-threaded tie rod bearing 202 and tie rod shaft 200 is threaded thereinto. Short cylindrical spacers 204 on either side of the ball joint end 198 serve to center the ball joint end between the bracket members 190.

Tie rods 147 and 191 are threaded in opposite hands. Consequently, support member 134 can be turned one way or the other with the result that the tie rods 147, 191 will be simultaneously screwed out of or into their respective bearings 182, 202. By this arrangement, the effective length of support member 134 can be shortened or lengthened. Shortening or lengthening the support members 134 would be desirable if the plane of the main frame 132 needed to be adjusted. Furthermore, shortening or lengthening the support members 134 might be necessary to adjust the wheelchair attachment 130 to a particular wheelchair frame orientation to establish the main frame 132 in an initial horizontal plane. Because both tie rods 147,191 are fitted with ball joint ends, and because the configuration for the main frame connectors 142 includes the ball-jointed tie rod ends, the wheelchair attachment can be fitted to wheelchairs having widths that are greater or narrower that the width of the main frame 132.

Figure 9:
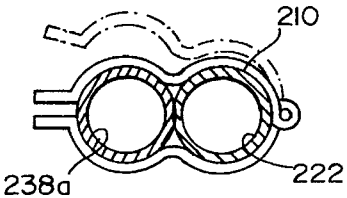
FIG. 9 is a detail view of an alternative connector for detachably connecting the main frame to a wheelchair.
Figure 8:
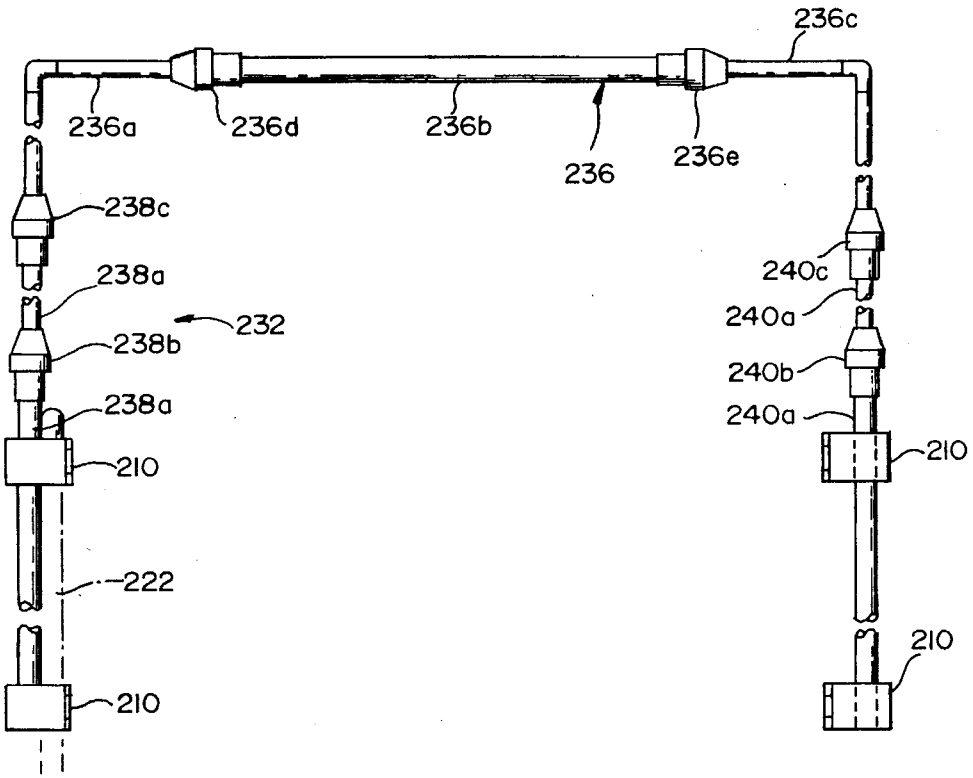
FIG. 8 is a top plan view of another version of a sectionalized main frame wherein adjacent sections are telescopically connected.

In some wheelchair configurations, it may be desirable to attach the wheelchair attachment to the wheelchair arms. Such a mode of attachment is illustrated in FIGS. 8 and 9 wherein clam shell type clamping members 210 are provided to detachably secure the main frame 232 to the wheel chair arms 222. FIG. 8 also illustrates an adjustable main frame 232 wherein the various segments, such as 238*a* and 240*a*, are telescopically joined by friction-lock joint sections 238*b*, 240*b*. Likewise, forward end section 236 could be telescopically joined to the main frame side segments by friction-lock joint sections 238*c*, 240*c*. The width of the main frame 232 could also be adjustable by providing the forward end section 236 in telescopic segments 236*a*, 236*b* and 236*c*, with segments 236*a*, 236c being corner-shaped and telescopically joined to mid-segment 236*b* by friction-lock joint sections 236*d*, 236*e*. The various segments would be tubular and of suitable diameters for fitting one in the other as appropriate. The friction-lock joint sections would be secured to the tubular segment of larger diameter and would accommodate the telescopic movement of the smaller-diametered segment therethrough. By turning the friction-gripping portion of a friction-lock joint section, the joint section could fix the adjacent tubular segments relative to one another. By this arrangement, the longitudinal length and transverse width of the main frame section 232 could be adjusted. When the wheelchair attachment is to be removed from the wheelchair and stowed away, the various segments could be telescoped together to make a compact more-easily stowed assembly without having to dismantle the various segments from one another.

Referring to FIG. 10 in particular, after the wheelchair attachment of this invention is secured to the wheelchair 10 and the attendant 11 has positioned himself within the enclosed frame 32 and gripped the forward end of the frame, the attendant is ready to proceed to pull the wheelchair behind him. To do so, the attendant will lift the forward end of the frame 32 so as to raise the wheelchair's front wheels 20 off the ground or walking surface 21. Then as the attendant pulls the wheelchair, because the small caster wheels 20 are clear of the ground, the larger rear wheels 16 of the wheelchair will afford the wheelchair occupant a relative smooth ride, even over rough terrain such as a hiking trail or a field or a graveled path or roadway. In order for the attendant to comfortably pull the wheelchair in the position illustrated in FIG. 10, the frame 32 and stabilizer 34 must be stiff enough to resist excessive bending so that the attendant need only lift the forward end of the frame a few inches to clear the front wheels 20 from ground 21. This requirement necessitates fabricating the frame 32 and stabilizer 34 from relatively rigid, inflexible materials to impart the necessary stiffness and resistance to excessive bending. For camping and hiking uses, where lightweight, strength and durability are important, the frame and stabilizer elements, as illustrated in FIGS. 4–7, may be fabricated from titanium. Aluminum tubing also may be suitable as a relatively lightweight and stiff material. An important aspect, however, is the whatever material is chosen, the end product—the frame 32 and stabilizers 34—must not be "whippy", that is to say the stabilized frame 32 must be able to extend essentially coplanar with little noticeable bending or drooping. If the frame 32 were about five feet in length, lifting the forward end up about 3–6 inches would effect an elevating of the front wheels 20 sufficient to adequately clear the ground for most terrain. One can see, however, that if the frame 32 is too flexible, the amount of lift required at the forward end of the frame 32 would become excessive. Moreover, a too flexible frame could effect an oscillatory bouncing action back at the wheelchair due to the walking action of the attendant as he pulled the wheelchair along. With a properly stiff enough frame 32, the attendant can push down on the forward end to pivot the wheelchair about its front wheels 20 to elevate the rear wheels 16 off the ground, such as might be required to pull the wheelchair up over a curbing or some other obstacle.

In certain instances a wheelchair occupant may desire that there be no obstructions in front of him. This might be the case if the occupant were fishing, hunting, skeet or trap shooting, bird watching, attending a sporting event, and so forth. In those situations, the pulling frame 30 (FIG. 1) or 130 (FIG. 4) might interfere with the viewing or the activity that engages the wheelchair occupant. On might just simply remove the frame and take it apart and temporarily store it for later re-attachment. But, because the frame is modularized, it is adaptable to another use in connection with a wheelchair. This is particularly so with respect to the preferred embodiment illustrated in FIGS. 4–7.

Figure 11:
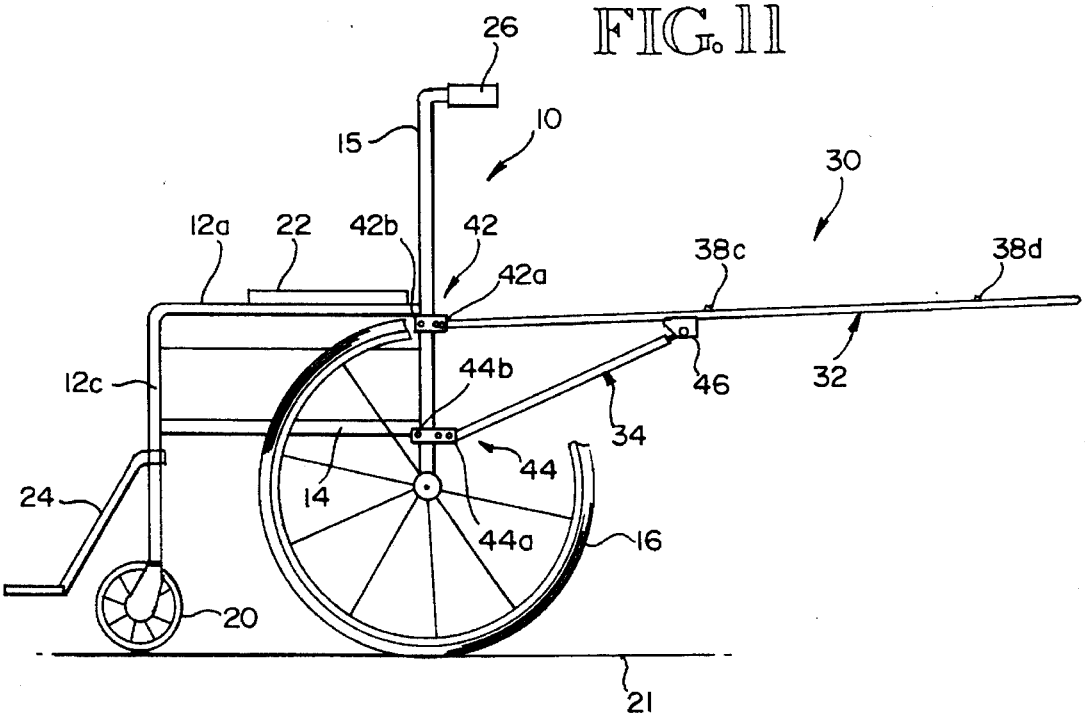
FIG. 11 is a side elevation view of a wheelchair with the attachment of this invention mounted to the wheelchair frame and projecting rearwardly of the wheelchair.

Considering the FIGS. 4–7 embodiment and FIG. 11, a duplicate set of wheelchair connectors 142, 144 could be attached to the wheelchair frame 12 behind the wheelchair seat, such as to the rear sections of the frame sides that mount the wheelchair back 15. Then the frame 130 could be attached to the rear of the wheelchair, rather than to the front, so that the wheelchair could be pushed into the desired locations for the viewing or activity. In this arrangement, the connectors 142, 144 would extend rearward. The innermost side segments 138*a*, 140*a* (with their attached support members 134) would extend rearward and either intermediate side segments 138*b*, 140*b* or the closed end section 136 would be attached to joints 138*c*, 140*c*. Because the joints 138*c*, 138*d* and 140*c*, 140*d* are identical, the closed end section 136 could be directly attached to joints 138*c*, 140*c* so as to eliminate intermediate side segments 138*b*, 140*b*. Thus, the extent of frame 132 would be shortened so as to make the system more maneuverable by the attendant in tight quarters.

While the preferred embodiment of the invention has been described herein, variations in the design may be made. The scope of the invention, therefore, is only to be limited by the claims appended hereto.

The embodiments of the invention in which an exclusive property is claimed are defined as follows:

I claim:

1. A wheelchair attachment which comprises frame means providing an enclosed frame having an end and two sides extendable from said end toward a wheelchair, the frame sides each comprising multiple elongated frame segments connectable axially of one another, the frame means further comprising interlockinq joint means detachably joining adjacent frame segments together; frame mounting means for detachably mounting said frame means to a wheelchair with said frame means projecting outwardly of the wheelchair; and frame support means connected to said frame means and detachably mountable to a wheelchair for positioning said frame means in a desired plane projecting outwardly of a wheelchair.

2. The wheelchair attachment of claim 1 wherein the frame sides each comprise multiple elongated tubular frame segments connectable axially of one another in end-to-end abutting relationship; and said interlocking joint means detachably joining adjacent frame segments together comprise multiple reinforcing sleeves constructed of a size to fit within an end of a tubular frame segment and to project from the tubular frame segment end, and multiple spring-loaded catch assemblies; some of said tubular frame segments each having at least one end that is fitted internally with a reinforcing sleeve that projects from that end, and others of said tubular frame segments each having at least one end that is adapted to fit over a projecting portion of a reinforcing sleeve that projects from the end of an adjacent tubular frame segment and to abut the adjacent tubular frame segment end; and each catch assembly being located in the projecting portion of a reinforcing sleeve and being adapted to releasably secure adjacent tubular frame segments in an abutting relationship; said tubular frame segments being of a size and said catch assemblies being so located that, when said tubular frame segments are interconnected, a smooth-walled and generally U-shaped enclosed frame is provided.

3. The wheelchair attachment of claim 2 wherein said frame mounting means comprises a pair of connectors, each connector having a first part attachable to a wheelchair and a second part attached to an innermost end of said enclosed frame, the first part of each connector of said frame mounting means comprising a clamp attachable to a wheelchair side frame member so as to provide an outward projection for attachment to the second part of the frame mounting means connector; and the second part of each frame mounting means connector comprising an internally-threaded mounting and a tie rod screwed into said internally-threaded mounting, said tie rod having an outer end detachably mountable to the projection of said first part so that said tie rod can be screwed into and out of its internally-threaded mounting to adjust the spacing of the frame sides relative to a wheelchair.

4. The wheelchair attachment of claim 2 wherein said frame support means comprises a pair of elongated support members, a pair of first connectors each pivotally mounting a forward end of one of said support members to one of the frame sides, and a pair of second connectors each having a first part attachable to a wheelchair and a second part attached to a rearwardmost end of one of said stabilizing segments, each elongated support member of said frame support means being adjustably attached to its first and second connectors so that the combination of each support member with its first and second connectors is extensible and retractable to effect said positioning of said frame.

5. The wheelchair attachment of claim 2 wherein said frame mounting means comprises a pair of connectors, each connector having a first part attachable to the wheelchair and a second part attached to a rearwardmost end of said enclosed frame; said first part comprising a clamp attachable to a wheelchair side frame member so as to provide a forwardly projecting clevis for attachment to said second part; and said second part comprising an internally-threaded mounting and a threaded tie rod screwed into said internally-threaded mounting, said tie rod having an outer end provided with a ball joint detachably mountable to said clevis, the internally-threaded mounting of said second part being attached to an end of one of said tubular frame segments whereby said tie rod can be screwed into and out of its internally-threaded mounting to adjust the spacing of the frame sides relative to the wheelchair.

6. The wheelchair attachment of claim 2 wherein said frame support means comprises a pair of elongated support members, a pair of first connectors each pivotally mounting a forward end of one of said support members to one of the frame sides, and a pair of second connectors each having a first part attachable to the wheelchair and a second part attached to a rearwardmost end of one of said support members; the first part of each second support connector comprising a clamp attachable to a wheelchair side frame member so as to provide a forwardly projecting clevis for attachment to said second part; and the second part of each second support connector comprising an internally-threaded mounting and a threaded tie rod screwed into said internally-threaded mounting, said tie rod having an outer end provided with a ball joint detachably mountable to said clevis, the internally-threaded mounting of said second part being attached to an end of one of said support members whereby said tie rod can be screwed into sand out of its internally-threaded mounting to adjust the spacing of the support members relative to the wheelchair.

7. The wheelchair attachment of claim 6 wherein said first support connectors each comprise a first part and a second part; the first part of each first support connector being attached to one of said tubular frame segments and providing a rearwardly- projecting clevis for attachment to said second part; and the second part of each first support connector comprising an internally-threaded mounting and a threaded tie rod screwed into said internally-threaded mounting, said tie rod having an outer end provided with a ball joint detachably mountable to said clevis, the internally-threaded mounting of said second part being attached to an end of one of said support members whereby said tie rod can be screwed into and out of its internally-threaded mounting to adjust the spacing of the support members relative to the wheelchair; and said first support connector tie rod and said second support connector tie rod being threaded in opposite hand whereby, after said attachment is attached to the wheelchair, the support members may by turned to simultaneously screw the tie rods into and out of their respective internally-threaded mountings to effect adjustment of the spacing of the support elements relative to a wheelchair.

8. The wheelchair attachment of claim 2 wherein:

said frame mounting means comprises a pair of frame connectors, each frame connector having a first part attachable to the wheelchair and a second part attached to a rearwardmost end of said enclosed frame; the first part of each frame connector comprising a clamp attachable to a wheelchair side frame member so as to provide a forwardly projecting clevis for attachment to said second part; and the second part of each frame connector comprising an internally-threaded mounting and a tie rod screwed into said internally-threaded mounting, said tie rod having an outer end provided with a ball joint detachably mountable to said clevis, the internally-threaded mounting of said second part being attached to an end of one of said tubular frame segments whereby said tie rod can be screwed into and out of its internally-threaded mounting to adjust the spacing of the frame sides relative to the wheelchair; and said frame support means comprises a pair of elongated support members, a pair of first support connectors each pivotally mounting a forward end of one of said support members to one of the frame sides, and a pair of second support connectors each having a first part attachable to the wheelchair and a second part attached to a rearwardmost end of one of said support members; the first part of each second support connector comprising a clamp attachable to a wheelchair side frame member so as to provide a forwardly projecting clevis for attachment to said second part; and the second part of each second support connector comprising an internally-threaded mounting and a tie rod screwed into said internally-threaded mounting, said tie rod having an outer end provided with a ball joint detachably mountable to said clevis, the internally-threaded mounting of said second part being attached to an end of one of said support members whereby said tie rod can be screwed into and out of its internally-threaded mounting to adjust the spacing of the support members relative to a wheelchair.

9. The wheelchair attachment of claim 8 wherein said first support connectors each comprise a first part and a second part; the first part of each first support connector being attached to one of said tubular frame segments and providing a rearwardly- projecting clevis for attachment to said second part; and the second part of each first support connector comprising an internally-threaded mounting and a threaded tie rod screwed into said internally-threaded mounting, said tie rod having an outer end provided with a ball joint detachably mountable to said clevis, the internally-threaded mounting of said second part being attached to an end of one of said support members whereby said tie rod can be screwed into and out of its internally-threaded mounting to adjust the spacing of the support members relative to the wheelchair; and said first support connector tie rod and said second support connector tie rod being threaded in opposite hand whereby, after said attachment is attached to the wheelchair, the support members may by turned to simultaneously screw the tie rods into and out of their respective internally-threaded mountings to effect adjustment of the spacing of the support elements relative to the wheelchair.

10. The wheelchair attachment of claim 1 wherein said frame mounting means comprises a pair of connectors, each connector having a first part attachable to a wheelchair and a second part attached to an innermost end of said enclosed frame, the first part of each connector of said frame mounting means comprising a clamp attachable to a wheelchair side frame member so as to provide an outward projection for attachment to the second part of the frame mounting means connector; and the second part of each frame mounting means connector comprising an internally-threaded mounting and a tie rod screwed into said internally-threaded mounting, said tie rod having an outer end detachably mountable to the projection of said first part so that said tie rod can be screwed into and out of its internally-threaded mounting to adjust the spacing of the frame sides relative to a wheelchair.

11. The wheelchair attachment of claim 1 wherein said frame support means comprises a pair of elongated support members, a pair of first connectors each pivotally mounting a forward end of one of said support members to one of the frame sides, and a pair of second connectors each having a first part attachable to a wheelchair and a second part attached to a rearwardmost end of one of said stabilizing segments, each elongated support member of said frame support means being adjustably attached to its first and second connectors so that the combination of each support member with its first and second connectors is extensible and retractable to effect said positioning of said frame means.

12. The wheelchair attachment of claim 11 wherein the first part of each second connector of said frame support means comprises a clamp attachable to a wheelchair side frame member so as to provide an outward projection for attachment to the second part of the frame stabilizing means second connector; and the second part of each frame stabilizing means second connector comprises an internally-threaded mounting and a tie rod screwed into said internally- threaded mounting, said tie rod having an outer end detachably mountable to the projection of said first part so that said tie rod can be screwed into and out of its internally-threaded mounting; and wherein said first support connectors mount said elongated support members to said elongated frame segments so that said support members may be angled downward from their respective first support connectors and so that their respective second support connectors may be attached to the wheelchair at an elevation lower than the attachment of said frame connectors to the wheelchair.

13. The wheelchair attachment of claim 12 wherein said frame connectors and said second support connectors are constructed so as to be attachable to a wheelchair side frame whereby said frame segments and said support members, when said attachment is attached to the wheelchair, will extend forward from the wheelchair without obstructing a wheelchair occupant's legroom.

14. The wheelchair attachment of claim 12 wherein said frame segments and said support members are fabricated in a form and from a material to render said frame forward end and sides stiff enough that, when said attachment is attached to the wheelchair, may be lifted up to raise a wheelchair's small front wheels clear of the ground whereby the the wheelchair may be pulled with its front wheels elevated.

15. The wheelchair attachment of claim 12 wherein said frame segments and said support members are fabricated in a form and from a material to render said frame forward end and sides stiff enough that, when said attachment is attached to the wheelchair, may be pushed down to raise a wheelchair's rear large wheels clear of the ground whereby the the wheelchair may be pulled with its rear wheels elevated.

16. The wheelchair attachment of claim 1 wherein the frame sides comprise multiple elongated frame segments telescopically connected whereby the frame sides can be extended and collapsed telescopically; and wherein said frame means interlocking joint means comprises telescopic friction locks fitted to frame segments and so constructed that the relative positions of telescoped frame segments can be secured by said telescopic friction locks.

17. A wheelchair attachment which comprises frame means providing an enclosed frame having an end and two sides extendable forwardly of said end toward a wheelchair, the frame sides each comprising multiple elongated frame segments connectable axially of one another, the frame means further comprising interlocking joint means detachably joining adjacent frame segments together in end-to-end abutting relationship; frame mounting means for detachably mounting said frame means to a wheelchair with said frame means projecting rearwardly of the wheelchair, said frame mounting means comprising a pair of connectors, each connector having a first part attachable to a wheelchair and a second part attached to an innermost end of said enclosed frame; and frame support means connected to said frame means and detachably mountable to a wheelchair for positioning said frame means in a desired plane projecting rearwardly of a wheelchair, said frame support means comprising a pair of elongated support members, a pair of first connectors each pivotally mounting an outer end of one of said support members to one of the frame sides, and a pair of second connectors each having a first part attachable to a wheelchair and a second part attached to an innermost end of one of said support members.

18. The wheelchair attachment of claim 17 wherein the frame sides each comprise multiple elongated tubular frame segments connectable axially of one another; and said interlocking joint means detachably joining adjacent frame segments together comprise multiple reinforcing sleeves constructed of a size to fit within an end of a tubular frame segment and to project from the tubular frame segment end, and multiple spring-loaded catch assemblies; some of said tubular frame segments each having at least one end that is fitted internally with a reinforcing sleeve that projects from that end, and others of said tubular frame segments each having at least one end that is adapted to fit over a projecting portion of a reinforcing sleeve that projects from the end of an adjacent tubular frame segment and to abut the adjacent tubular frame segment end; and each catch assembly being located in the projecting portion of a reinforcing sleeve and being adapted to releasably secure adjacent tubular frame segments in an abutting relationship; said tubular frame segments being of a size and said catch assemblies being so located that, when said tubular frame segments are interconnected, a smooth-walled and generally U-shaped enclosed frame is provided.

19. The wheelchair attachment of claim 18 wherein the first part of each connector of said frame mounting means comprises a clamp attachable to a wheelchair side frame member so as to provide an outward projection for attachment to the second part of the frame mounting means connector; and the second part of each frame mounting means connector comprises an internally-threaded mounting and a tie rod screwed into said internally-threaded mounting, said tie rod having an outer end detachably mountable to the projection of said first part so that said tie rod can be screwed into and out of its internally-threaded mounting to adjust the spacing of the side frame member relative to a wheelchair.

20. The wheelchair attachment of claim 18 wherein each elongated support member of said frame support means is adjustably attached to its first and second connectors so that the combination of each support member with its first and second connectors is extensible and retractable to effect said positioning of said frame support means.

21. The wheelchair attachment of claim 17 wherein the first part of each connector of said frame mounting means comprises a clamp attachable to a wheelchair side frame member so as to provide an outward projection for attachment to the second part of the frame mounting means connector; and the second part of each frame mounting means connector comprises an internally-threaded mounting and a tie rod screwed into said internally-threaded mounting, said tie rod having an outer end detachably mountable to the projection of said first part so that said tie rod can be screwed into and out of its internally-threaded mounting to adjust the spacing of the side frame member relative to a wheelchair.

22. The wheelchair attachment of claim 17 wherein each elongated support member of said frame support means is adjustably attached to its first and second connectors so that the combination of each support member with its first and second connectors is extensible and retractable to effect said positioning of said frame support means.

* * * * *